US008739752B2

(12) United States Patent
Honzawa et al.

(10) Patent No.: US 8,739,752 B2
(45) Date of Patent: Jun. 3, 2014

(54) INTAKE DUCT FOR VEHICLES

(75) Inventors: Shinichi Honzawa, Anjo (JP); Shinya Makihara, Anjo (JP); Koichi Hosaka, Anjo (JP)

(73) Assignee: Inoac Corporation, Aichi (JP)

( * ) Notice: Subject to any disclaimer, the term of this patent is extended or adjusted under 35 U.S.C. 154(b) by 927 days.

(21) Appl. No.: 12/383,525

(22) Filed: Mar. 25, 2009

(65) Prior Publication Data

US 2009/0255501 A1 Oct. 15, 2009

(30) Foreign Application Priority Data

Apr. 10, 2008 (JP) ..... 2008-102833

(51) Int. Cl.
*F02M 35/10* (2006.01)

(52) U.S. Cl.
USPC ..... 123/184.59; 123/184.21; 123/41.04; 123/41.58; 293/148; 180/68.1

(58) Field of Classification Search
USPC ..... D12/173, 345, 196, 90–92; 180/69.22, 180/68.3, 69.2, 69.25, 68.1; 123/198 E, 123/195 C, 184.21, 563, 559.1, 184.43, 123/184.48, 184.34, 184.53, 184.57, 123/184.35, 184.36, 210, 41.1, 41.13, 123/184.59, 41.04, 41.56, 41.58; D15/1–5, D15/150; 293/146, 147, 148; 137/338, 339, 137/340
See application file for complete search history.

(56) References Cited

U.S. PATENT DOCUMENTS

| | | | | |
|---|---|---|---|---|
| 3,385,195 | A | 5/1968 | Farr | |
| 3,641,746 | A * | 2/1972 | Smith et al. | 55/385.3 |
| 3,800,910 | A * | 4/1974 | Rose | 181/229 |
| 4,420,057 | A * | 12/1983 | Omote et al. | 180/68.3 |
| 4,533,012 | A * | 8/1985 | Komoda | 180/68.3 |
| 4,548,166 | A * | 10/1985 | Gest | 123/198 E |
| 5,078,341 | A * | 1/1992 | Bichler et al. | 244/53 B |
| 5,794,733 | A * | 8/1998 | Stosel et al. | 180/68.1 |
| 6,405,819 | B1 * | 6/2002 | Ohkura et al. | 180/68.1 |
| 6,527,317 | B2 * | 3/2003 | Fox et al. | 293/115 |
| 6,540,275 | B1 * | 4/2003 | Iwamoto et al. | 293/24 |
| 6,848,524 | B2 * | 2/2005 | Vaillancourt et al. | 180/68.1 |
| 6,880,655 | B2 * | 4/2005 | Suwa et al. | 180/68.1 |
| 6,918,456 | B2 * | 7/2005 | Dennison et al. | 180/68.1 |
| 6,921,117 | B2 * | 7/2005 | Rackham et al. | 293/115 |
| 6,923,286 | B2 * | 8/2005 | Sato et al. | 180/274 |
| 6,969,097 | B2 * | 11/2005 | Tanaka | 293/115 |

(Continued)

FOREIGN PATENT DOCUMENTS

| | | |
|---|---|---|
| DE | 44 01 186 | 7/1994 |
| EP | 1 464 825 | 10/2004 |

(Continued)

*Primary Examiner* — Noah Kamen
*Assistant Examiner* — Grant Moubry
(74) *Attorney, Agent, or Firm* — DLA Piper LLP (US)

(57) ABSTRACT

An intake duct for a vehicle having an inlet port formed so that the open side faces obliquely upward. The intake duct includes an inlet part formed in a flat shape expanding in the lateral direction crossing an air stream direction and a deflector provided in an air stream passage of the inlet part and extending in the left-and-right direction of the air stream passage. The intake duct further includes a first support member, which is provided between the deflector and the lower wall portion of the inlet part, and a second support member, which is provided between the deflector and the upper wall portion of the inlet part.

14 Claims, 6 Drawing Sheets

(56) References Cited

U.S. PATENT DOCUMENTS

| | | | | |
|---|---|---|---|---|
| 7,171,986 | B2 * | 2/2007 | Canova et al. | 138/37 |
| 7,461,875 | B2 * | 12/2008 | Kobayashi et al. | 293/115 |
| 7,762,367 | B2 * | 7/2010 | Yamaguchi et al. | 180/68.1 |
| 7,887,125 | B2 * | 2/2011 | Tazaki et al. | 296/193.1 |
| 8,137,425 | B2 * | 3/2012 | Saito et al. | 55/385.3 |
| 8,157,040 | B2 * | 4/2012 | Khouw et al. | 180/68.3 |
| 8,544,454 | B2 * | 10/2013 | Geskes et al. | 123/568.12 |
| 2002/0153181 | A1 * | 10/2002 | Nakamura | 180/68.1 |
| 2008/0142285 | A1 * | 6/2008 | McCurdy et al. | 180/68.1 |

FOREIGN PATENT DOCUMENTS

| | | | |
|---|---|---|---|
| EP | 1 865 185 | | 12/2007 |
| FR | 2 879 971 | | 6/2006 |
| JP | H6-221238 | A | 8/1994 |
| JP | H6-85905 | A | 12/1994 |
| JP | H9-195859 | | 7/1997 |
| JP | 2001-304057 | A | 10/2001 |
| JP | 2004-276869 | A | 10/2004 |
| JP | 2006-322434 | | 11/2006 |
| JP | 2007-331607 | A | 12/2007 |

* cited by examiner

INTAKE DUCT FOR VEHICLES

BACKGROUND OF THE INVENTION

1. Field of the Invention

The present invention relates to an intake duct for a vehicle, which supplies air into an engine.

2. Description of the Related Art

As shown in FIG. 7, in vehicles, the outside air taken through a vehicular intake duct DC is supplied into an engine EG, via an air cleaner AC (see Japanese Patent Application Laid-Open No. 2006-322434). This vehicular intake duct DC is made by injection molding or blow molding of a synthetic resin and has an air stream passage 20 defined therein. As shown in FIG. 8, the vehicular intake duct DC is provided with an inlet part 22 having an inlet port 24 and formed into a laterally elongated flat shape. An outlet part 26 having an outlet port 28 connected to the air cleaner AC is formed in a substantially rectangular shape. Further, the vehicular intake duct DC is bent at a midway portion between the inlet part 22 and the outlet part 26. The inlet part 22 of the vehicular intake duct DC is, as shown in FIG. 7, attached to the top face of a radiator support 16 by bolts BL. Also in this construction, the inlet port 24 of the duct DC is disposed to face a small space S which is between an engine hood 14 of an engine room 12 and the radiator support 16.

Recently, safety measures against contact of a vehicle with a pedestrian have been enhanced; as a result, it is designed so that at the time of collision of a vehicle against the pedestrian, the engine hood 14 deforms downward to some extent to absorb the impact. This requires the vehicular intake duct DC located directly under the engine hood 14 not to interfere with the deformation of the engine hood 14. In addition, the vehicular intake duct DC needs to absorb the impact transmitted via the engine hood 14 as well as permits the deformation of the engine hood 14.

As mentioned above, because the inlet part 22 of the vehicular intake duct DS is disposed in the small space S, the open end of the inlet part 22 is formed to be inclined rearward and upward from the lower part to secure the stroke needed at the time the engine hood 14 deforms. In other words, the inlet port 24 provided at the open end of the inlet part 22 is inclined to face obliquely upward. Generally, air has such a property as to flow into the open side of the inlet port 24 of the vehicular intake duct DC at an angle orthogonal to the open side. As seen from FIG. 7, therefore, after flowing obliquely downward through the inlet port 24, the air flows, as shown by curve dotted lines, horizontally along the inner surfaces of the wall portions constituting the air stream passage 20. Since the air taken through the inlet port 24 tends to flow along the incident line directed obliquely downward in the aforementioned manner, the air stream tends to come away from the inner surface of the upper wall portion and to be biased in the lower area of the air stream passage 20. When this occurs, the air counter-flows in the upper area R of the air stream passage 20 at the inlet part 22. As is apparent from the above, when the open side of the inlet port 24 is formed askew, biasing and counter flow of the air stream occur in the air stream passage 20 of the inlet part 22. Both of these would stand in the way of smooth ventilation and lower the air ventilating performance of the intake duct.

SUMMARY OF THE INVENTION

Accordingly, it is an object of the present invention to overcome the foregoing inherent problem of the vehicular intake duct and to provide an intake duct for a vehicle, which has an impact absorbing capability.

It is another object of the invention to provide an intake duct for a vehicle that suppresses biasing of an air stream and occurrence of counter flow of an air stream both of which would deteriorate the air ventilating performance at the time when the inlet port of the intake duct is formed askew.

The above objects are accomplished by a unique structure of the present invention for an intake duct for a vehicle that has an air stream passage defined therein and communicates with the inlet port and the outlet port, and in the present invention, the intake duct comprises:

- an inlet part having the inlet port and formed in a flat shape expanding in the lateral direction crossing the air stream direction extending from the inlet port to the outlet port; and
- a plate member provided in the air stream passage of the inlet part so as to extend in the lateral direction crossing the air stream direction.

In this vehicular intake duct of the present invention, when the upper wall portion of the inlet part is pressed down, the plate member extending laterally and crossing the air stream passage of the inlet part elastically deforms between both side wall portions of the inlet part to absorb the impact.

According to the vehicular intake duct of the present invention, the plate member provided in the air stream passage improves the impact absorbing capability. Further, even if the inlet port of the inlet part is formed askew, the plate member suppresses biasing of the air stream and the occurrence of the counter flow of the air stream.

BRIEF DESCRIPTION OF THE DRAWINGS

FIGS. 3A to 3D are front views of the vehicular intake duct as seen from the inlet port side, FIG. 3A showing a normal state while FIGS. 3B to 3D show how the duct deforms by the deformation of the upper wall portion;

DETAILED DESCRIPTION OF THE PREFERRED EMBODIMENT

Figure 7:
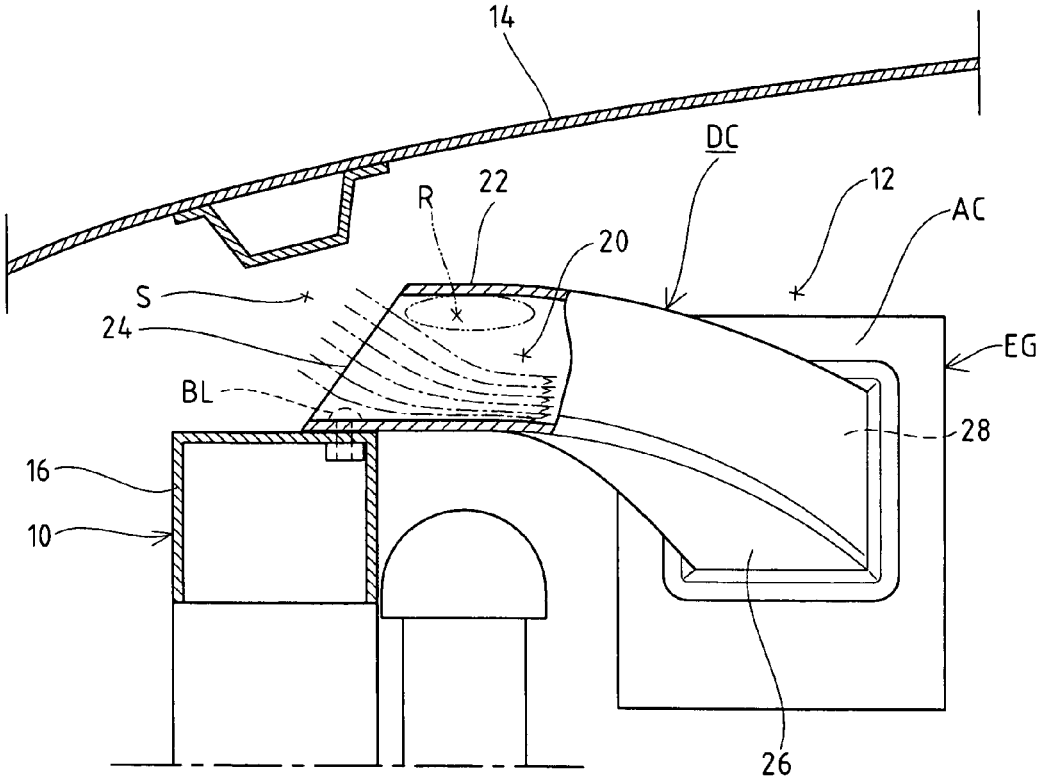
FIG.7 (Prior Art)
FIG. 7 is a side cross-sectional view showing a conventional vehicular intake duct mounted to the body of a vehicle.
Figure 8:
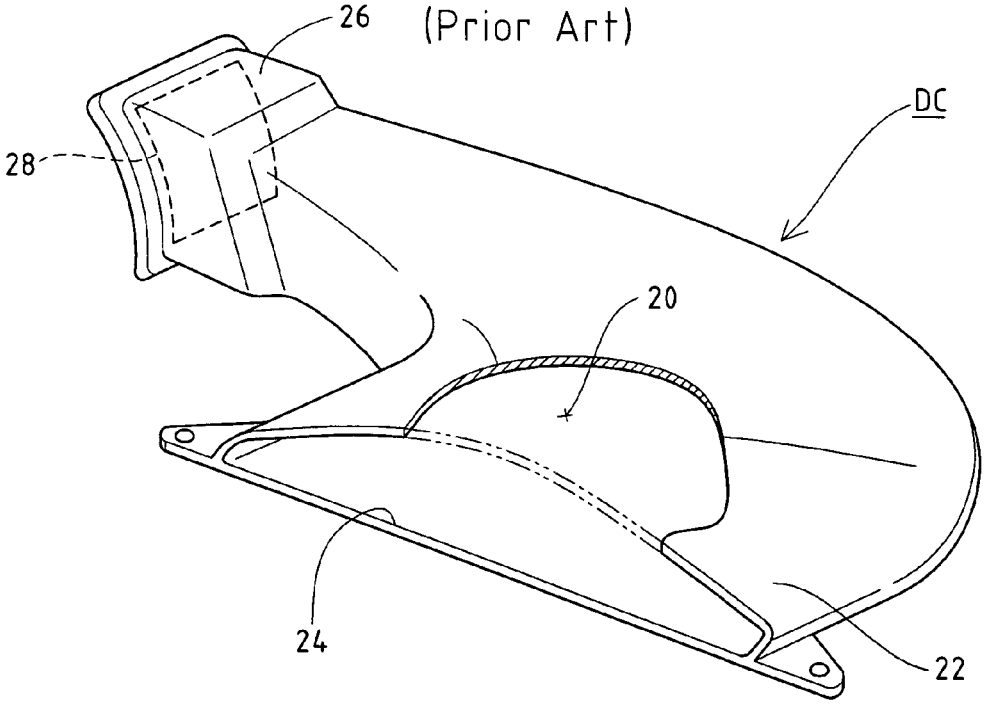
FIG.8 (Prior Art)
FIG. 8 is a partly cutaway perspective view of the conventional vehicular intake duct.

Preferred embodiments of a vehicular intake duct according to the present invention will be described below referring to the accompanying drawings. For the sake of descriptive convenience, the same reference numerals are given to those components which are the same as the corresponding components of the vehicle shown in FIG. 7. In the following description of the vehicular intake duct of the present invention, the reference direction is a direction in which the air flows in the air stream passage, defined in the vehicular intake duct, toward the outlet port from the inlet port. The upstream side (inlet port side) in the air stream direction in the vehicular intake duct is called the "front side", while the downstream side (outlet port side) in the air stream direction is called the "rear side". In addition, the lateral direction orthogonal to the air stream direction of the vehicular intake duct mounted in a vehicle body is called the left-and-right direction.

Figure 1:
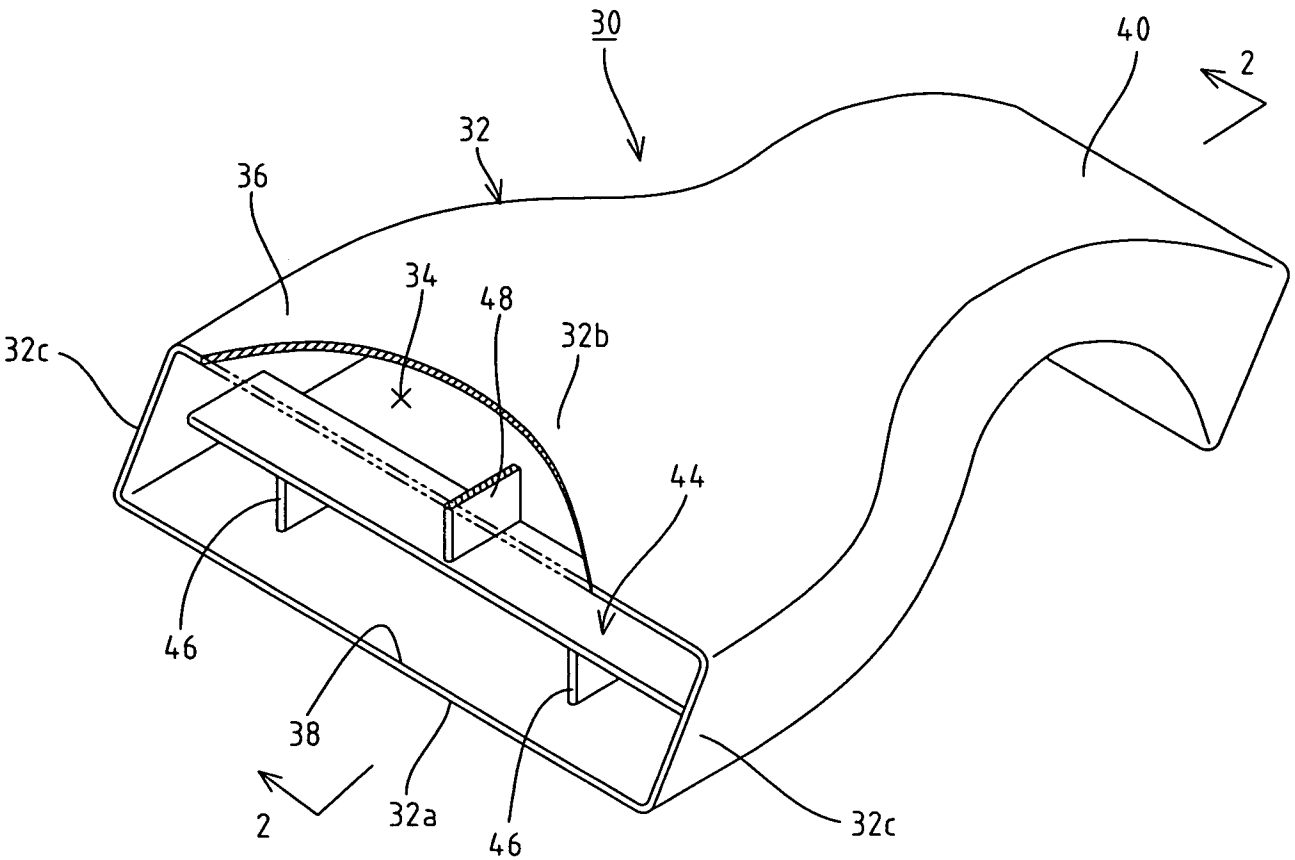
FIG. 1 is a partly cutaway perspective view of a vehicular intake duct according to a preferable embodiment of the present invention.
Figure 2:
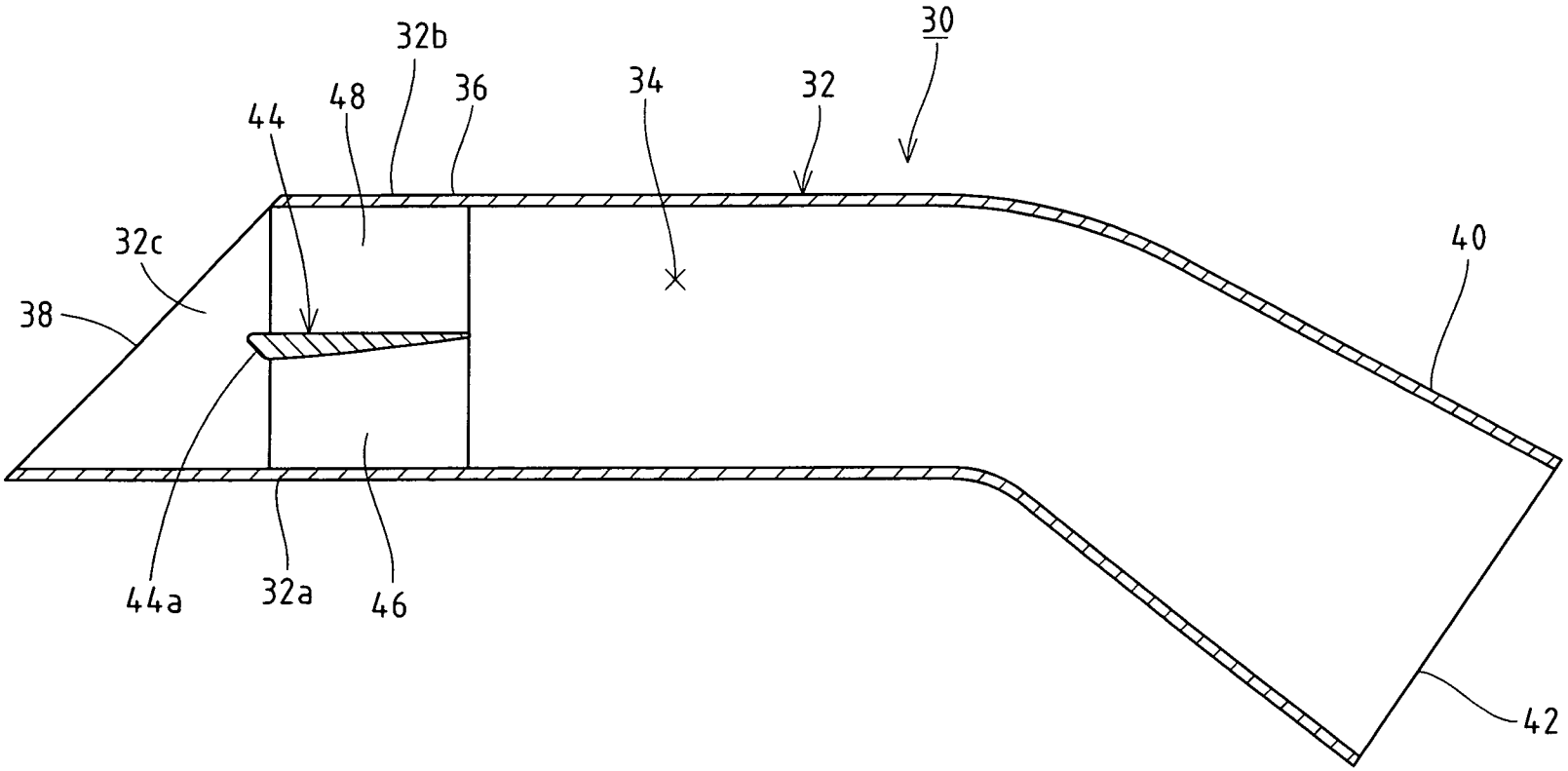
FIG. 2 is a cross-sectional view taken along the line 2-2 in FIG. 1.

As shown in FIGS. 1 and 2, a vehicular intake duct (herein referred to as a "duct") 30 is comprised of a duct body 32 with its both ends opened, and an air stream passage 34 that communicates with an inlet port 38 and an outlet port 42 is defined inside the duct body 32. The duct body 32 is a flexible molded piece of a synthetic resin. The duct body 32 has an inlet part 36 positioned on the front side in the air stream direction and having a flat shape expanding laterally or in the left-and-right direction. The inlet port 38 in a laterally expanding flat shape is provided at the open end of the inlet part 36. The duct body 32 is further provided with an outlet part 40 positioned on the rear side in the air stream direction and having a substantially rectangular shape. The outlet port 42 in a substantially rectangular shape is provided at the open end of the outlet part 40. Further, the duct body 32 is bent at its midway portion in the forward-and-backward direction extending from the inlet port 38 to the outlet port 42, so that the inlet part 36 extends in a substantially horizontal direction when the duct body 32 is mounted in a vehicle body 10.

The duct 30 is, as best seen from FIG. 2, formed so as to be inclined rearward in the air stream direction as the open end of the inlet part 36 extends upward from the lower part thereof. Therefore, the inlet port 38 which opens at the open end of the inlet part 36 faces obliquely upward. More specifically, as shown by the two-dot chain lines in FIG. 4, the incoming line of the air taken orthogonally to the inlet port 38 crosses the flow line of the air stream passage 34 which is guided by wall portions 32*a*, 32*b* and 32*c* (see FIG. 1) of the inlet part 36 that extend in a substantially horizontal direction. The thus structured duct 30 is, as can seen from FIG. 7, mounted with the inlet port 38 of the inlet part 36 facing the space S between the radiator support 16, which is arranged in the front side of an engine room 12, and an engine hood 14.

Figure 3:
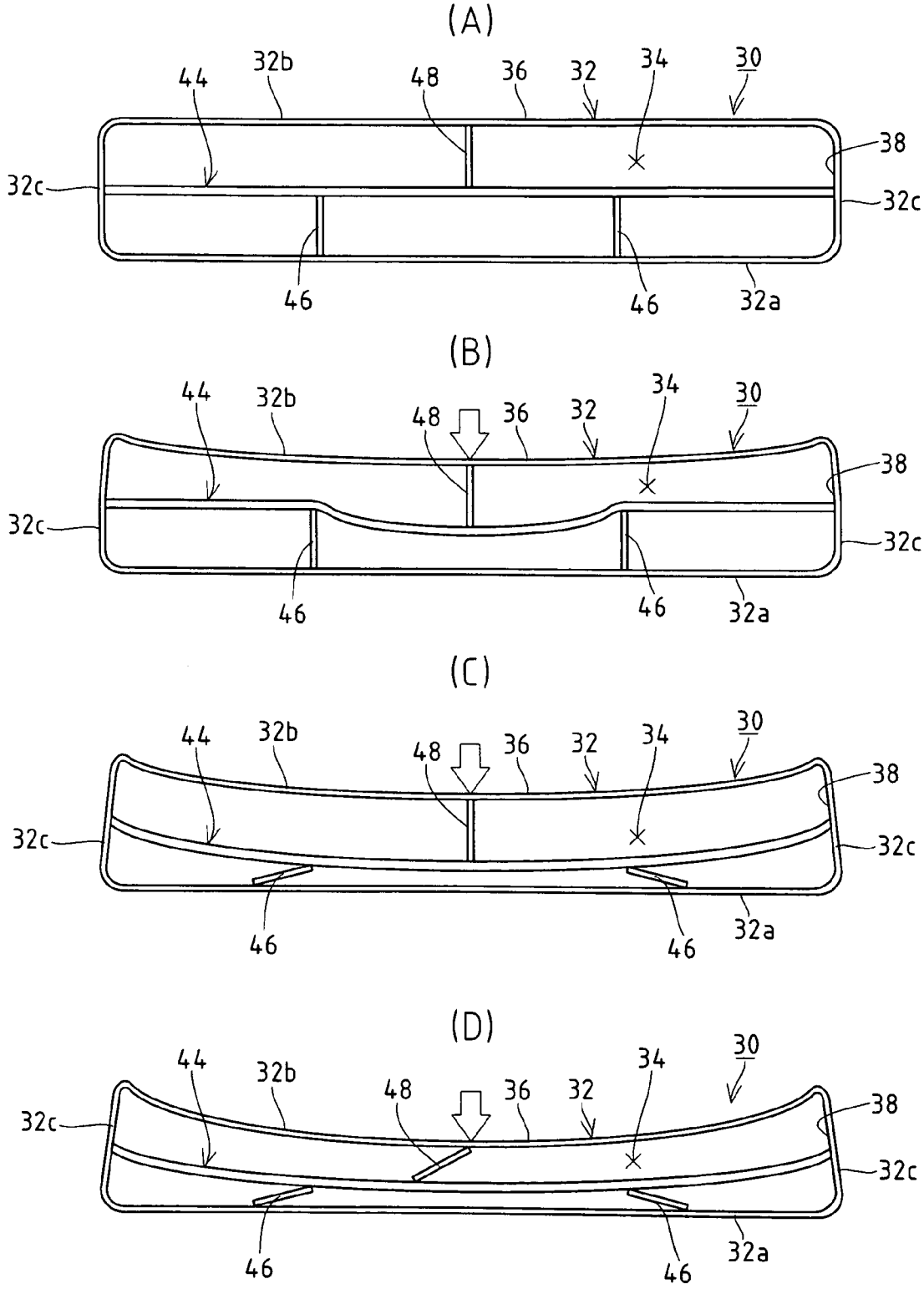

As shown in FIG. 3A, the duct 30 has a deflector (plate member) 44 extending in the left-and-right direction of the air stream passage 34 and provided inside the inlet part 36. The deflector 44 is a flexible plate-like member of a synthetic resin. As shown in FIG. 2, the deflector 44 is disposed at a middle portion of the air stream passage 34 in the up-and-down direction, with its both top and bottom sides respectively facing the lower wall portion 32*a* and the upper wall portion 32*b*. In the duct 30, the deflector 44 extends between the left and right wall portions 32*c* constituting the side wall portions of the duct body 32, and thus the deflector 44 separates the air stream passage 34 into a lower area and an upper area.

The deflector 44 has a front end positioned on the front side in the air stream direction, and this front end is located at a position where it is aligned with the open end of the inlet part 36 or is slightly rearward of that open end. It is preferable that the front end of the deflector 44 is located on the front side of the incoming line of the air flowing toward the lower wall portion 32*a* from the topmost end of the inlet port 38. It is further preferable that the rear end of the deflector 44, which is positioned on the rear side in the air stream direction, is located on the rear side of the incoming line of the air flowing toward the lower wall portion 32*a* from the topmost end of the inlet port 38 and also be located on the front side of the portion of the duct body 32 where the air stream passage 34 is bent. This is because if the deflector 44 is not disposed at the position crossing the incoming line of the air taken through the inlet port 38, the performance of guiding the air taken through the inlet port 38 to the upper area of the air stream passage 34 drops. If the deflector 44 protrudes outside through the inlet port 38, the deflector 44 interferes with the air stream drawn into the lower area of the inlet port 38 which is separated by the deflector 44. Further, if the deflector 44 extends to the bent portion of the duct body 32, it leads to a loss of the pressure of the air stream in the air stream passage 34.

Figure 4:
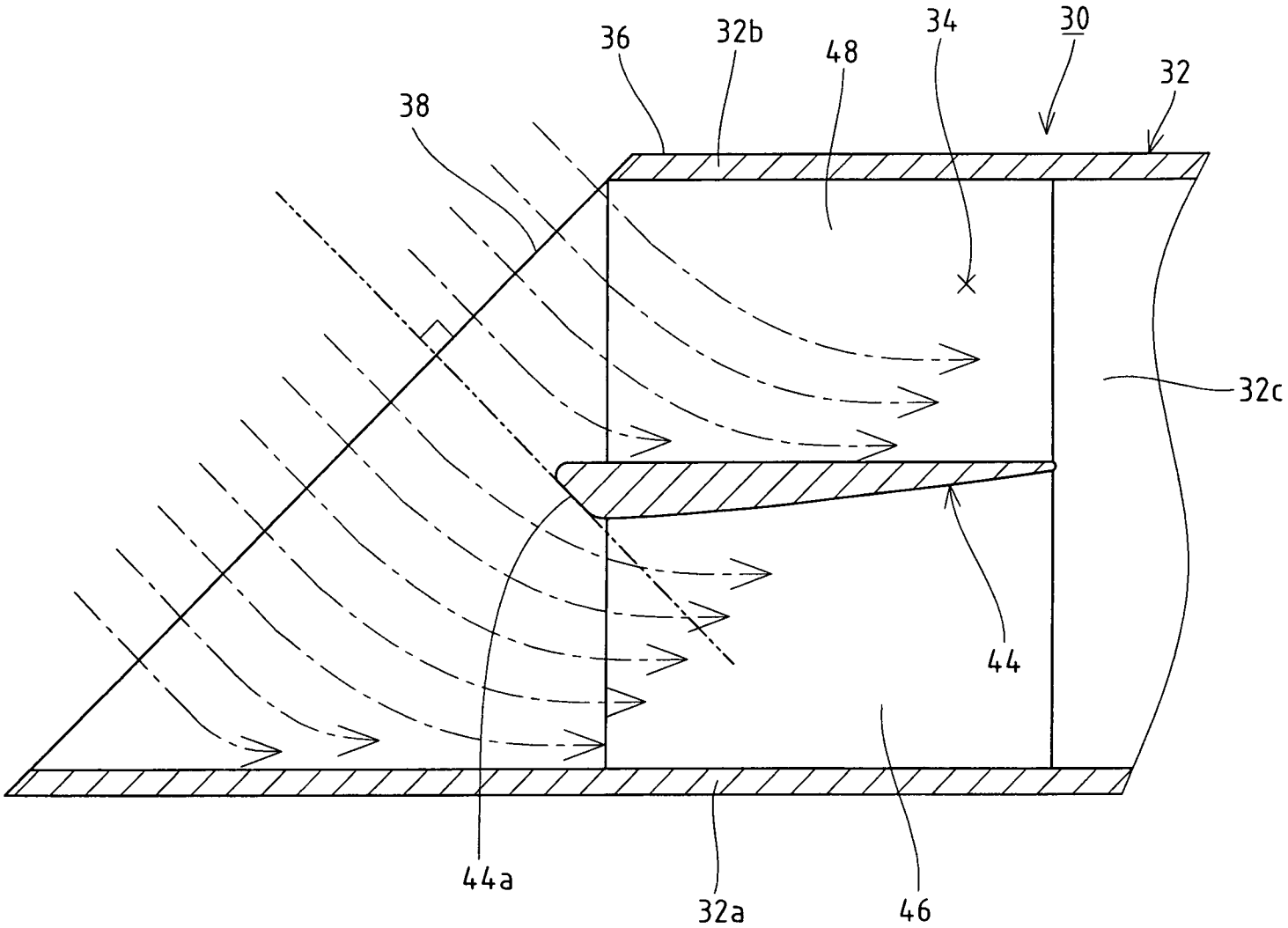
FIG. 4 is an enlarged side cross-sectional view showing the inlet part of the vehicular intake duct.

As shown in FIG. 4, the deflector 44 is formed to have a streamline cross-sectional shape which matches with the flow of the air passing through the air stream passage 34. The top side of the deflector 44 is formed flat in parallel to the inner side of the upper wall portion 32*b* constituting the top side of the duct body 32 which extends approximately horizontally in the forward-and-backward direction. The bottom side of the deflector 44 has a guide face 44*a* inclined downward from the front end of the deflector 44 toward the rear side in the air stream direction. Further, the bottom side of the deflector 44 is formed so as to be inclined upward from the inclined lower end of the guide face 44*a* toward the rear side in the air stream direction. In other words, the thickness of the vertical cross-sectional shape of the deflector 44 becomes thinner from the thick front end portion (or the guide face 44*a*) extending downward toward the rear side in the air stream direction. The guide face 44*a* is formed to match (or to be parallel to) the incoming line of the air into the inlet port 38. The guide face 44*a* of the deflector 44 is not limited to the flat surface, and it can be formed into a curved surface. When the guide face 44*a* is curved outward, it is preferable to form the guide face 44*a* so that the chord connecting the front end of the deflector 44 to the inclined lower end of the guide face 44*a* matches the air incoming line.

The duct 30 has, as seen from FIG. 1, first support members 46 provided between the deflector 44 and the lower wall portion 32*a* constituting the bottom side of the inlet part 36. The duct 30 has also a second support member 48 provided between the deflector 44 and the upper wall portion 32*b* constituting the top side of the inlet part 36. Each of the first support members 46 and the second support member 48 is a plate-like element of a synthetic resin and is disposed so that its top and bottom sides extend in the air stream direction. The first support members 46 are provided between the lower wall portion 32*a* and the bottom side of the deflector 44, with its upper end connected to the bottom side of the deflector 44 while its lower end abuts on the lower wall portion 32*a*. The lower end of the first support member 46 and the lower wall portion 32*a* are thus not fixed together. The second support member 48 is provided between the upper wall portion 32*b* and the top side of the deflector 44, with its upper end connected to the upper wall portion 32*b* while its lower end abuts on the top side of the deflector 44. In the shown embodiment, the lower end of the second support member 48 and the deflector 44 are not fixed together.

The first support members 46 and the second support member 48 are disposed at vertically different positions with the deflector 44 in between. More specifically, as best seen from FIG. 3A, the first support members 46 and the second support member 48 are disposed at positions at which they do not overlie one another in the left-and-right direction. In the duct 30, as shown in FIG. 3A, the first support members 46 and the second support member 48 are disposed at positions apart from one another in the left-and-right direction. In other words, two first support members 46 are disposed apart from each other in the left-and-right direction, and a single second support member 48 is disposed at the position corresponding to the middle of the two first support members 46.

The duct 30 is made by injection molding, blow molding or the like. The first support members 46, the second support member 48 and the duct body 32 can be molded integrally, or they can be molded separately and then assembled together into a single body. The above-described duct 30 is configured so that the duct body 32 is formed by blow molding, and the deflector 44, the first support members 46 and the second support member 48 which are molded separately from the duct body 32 are assembled to the duct body 32.

According to the duct 30 described above, as shown in FIG. 4, the deflector 44 extending in the left-and-right direction is provided in the air stream passage 34 on the inlet part 36 side. Owing to this construction, part of the air taken through the inlet port 38 facing obliquely upward is guided by the deflector 44 to flow to the upper area of the air stream passage 34. In other words, while the air taken through the upper area of the inlet port 38 flows obliquely downward along the air incoming line, the air is guided along the top side of the deflector 44 disposed on the air incoming line. This allows the air stream to be guided toward the upper area of the air stream passage 34, thus suppressing biasing of the air stream in the lower area. Because the air stream flows through the upper area of the air stream passage 34 in the duct 30, it is possible to suppress the separation of the air stream from the inner surface of the upper wall portion 32*b*, which would occur in the upper area of the air stream passage 34. As the duct 30 suppresses the separation of the air stream in the upper area of the air stream passage 34 at the inlet part 36 this way, counter flow of the air stream and generation of stagnation can be minimized. Though the open side of the inlet port 38 is formed askew or inclined, therefore, the duct 30 can suppress the pressure loss of the air stream in the air stream passage 34 at the inlet part 36 adequately supply the air to the engine EG.

Pressure loss of the air stream is reduced more by the deflector 44 of the streamline shape compared to a deflector of a flat shape. The deflector 44 has the guide face 44*a*, matching the air stream from the inlet port 38, at the bottom side of the front end portion. Therefore, air is smoothly guided to the lower area of the air stream passage 34 from the inlet port 38 along the guide face 44*a*. In other words, the deflector 44 minimizes the influence on the air stream flowing into the lower area. Further, because the first support member 46 and the second support member 48 extend in the forward-and-backward direction, it is possible to reduce the pressure loss of the air stream without interfering with the air stream.

In the duct 30, as shown in FIG. 3A, the deflector 44 is supported by the first support members 46 provided between the lower wall portion 32*a* and the deflector 44, and the upper wall portion 32*b* is supported by the second support member 48 provided between the deflector 44 and the upper wall portion 32*b*. Accordingly, even if the duct body 32 becomes soft due to the negative pressure generated in the air stream passage 34 or to the rise in the temperature in the engine room 12 at the time the engine EG is driven, deformation of the duct body 32 is suppressed. In other words, the duct 30 in normal use can maintain the cross-sectional area of the air stream passage 34, thus allowing air to be adequately supplied to the engine EG.

Referring to FIGS. 3A to 3D, a case where the engine hood 14 is deformed by a collision of a person or the like and the deformed engine hood 14 presses the upper wall portion 32*b* of the duct 30 downward will be described below. When the upper wall portion 32*b* of the duct 30 is pressed downward, the second support member 48 is first displaced downward according to the deformation of the upper wall portion 32*b* and presses the deflector 44. At this time, the right and left wall portions 32*c* tend to fall in the direction of approaching each other with the lower ends being the points of support as the upper wall portion 32*b* deforms downward. As the deflector 44 between the right and left wall portions 32*c* props, however, the right and left wall portions 32*c* are displaced with the resistance applied thereto, as shown in FIG. 3B. When the deflector 44 is pressed downward by the second support member 48, a part of the deflector 44 that is between the two first support members 46 works like a plate spring and deforms elastically because of the flexibility. As a result, the second support member 48 is displaced downward with the resistance applied thereto. Here, the first support members 46 and the second support member 48 are provided at vertically different positions with the deflector 44 in between. Therefore, the deflector 44 which receives the downward displacement of the second support member 48 is not interfered with the first support members 46 and deforms downward elastically.

As the deflector 44 takes the downward displacement further, each of the first support members 46 pushed by the deflector 44 deforms in the left-and-right direction with the upper end being the point of support because the lower end of each first support member 46 is not fixed to the lower wall portion 32*a*. As the first support members 46, which have served as props between the deflector 44 and the lower wall portion 32*a*, deform obliquely, further deformation of the deflector 44 is permitted in the duct 30. Likewise, as the upper wall portion 32*b* takes the downward displacement further, the second support member 48 pushed by the upper wall portion 32*b* deforms in the left-and-right direction with the upper end being the point of support because the lower end of the second support member 48 is not fixed to the deflector 44. As the second support member 48, which has served as a prop between the deflector 44 and the upper wall portion 32*b*, deforms obliquely, the upper wall portion 32*b* deforms further into the duct 30. As a result, the deformation of the first support members 46 and the second support member 48 provides multiple displacement distances to the upper wall portion 32*b*. Because the duct 30 adequately deforms according to the deformation of the engine hood 14 like this while resisting against the deformation of the engine hood 14, the duct 30 can thus absorb the impact smoothly.

The present invention is not limited to the foregoing embodiment can may adopt the following structures.

Figure 5:
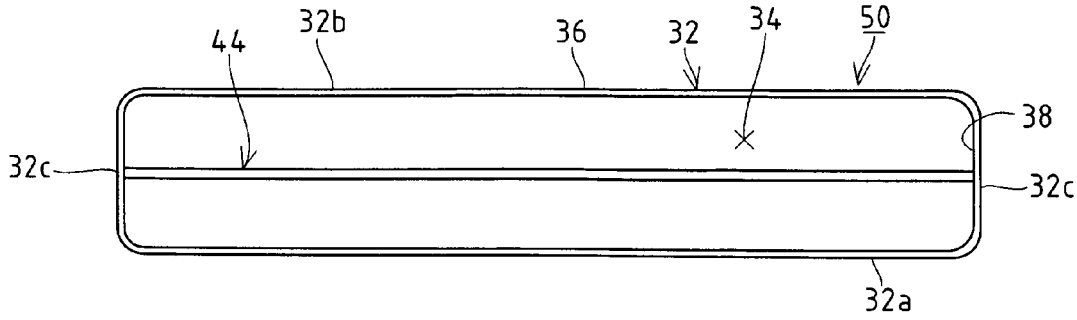
FIG. 5 is a front view of a vehicular intake duct according to a modification of the present invention as seen from the inlet port side.
Figure 6:
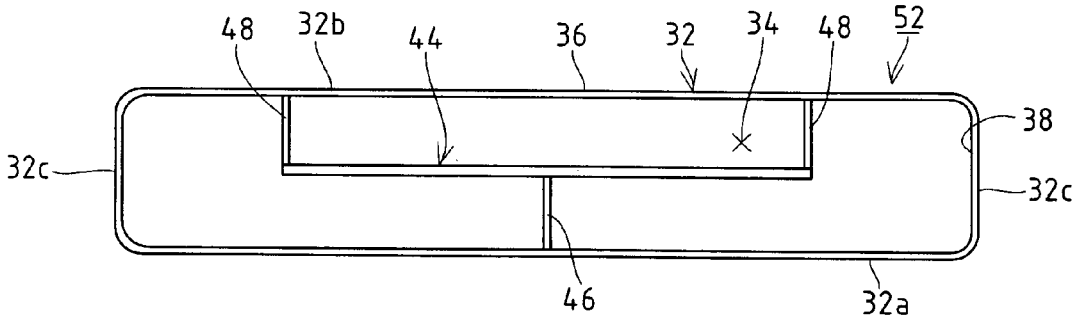
FIG. 6 is a front view of a vehicular intake duct according to another modification of the present invention as seen from the inlet port side.

(1) The first support member and the second support member are not particularly limited to the quantities and the locations as long as both support members do not overlie each other. For example, only the deflector 44 as a plate member extending in the left-and-right direction can be provided in the air stream passage 34 without the first support member 46 and the second support member 48 as in a vehicular intake duct 50 shown in FIG. 5. Further, one first support member 46 can be provided at the middle portion in the left-and-right direction and two second support members 48 can be disposed apart from each other in the left-and-right direction with the first support member 46 in between as in a vehicular intake duct 52 shown in FIG. 6. The vehicular intake duct 52 is configured in such a way that the deflector 44 extends only between the two second support members 48.

(2) Plural plate members can be provided in the up-and-down direction.

(3) The first support member and the second support member are not limited to plate-like members, and they can take, for example, a rectangular cross-sectional shape, a circular pillar shape or so, and they can also take a streamline cross-sectional shape that matches the air flow.

(4) The deflector as a plate member can take a shape that is similar to the shape of the upper wall portion of the duct body. In other words, if the upper wall portion has a shape curved downwardly, then the deflector (plate member) can be of a shape generally curved downward along the downwardly curved upper wall portion.

(5) The manner of connection of the first support member and the second support member is not limited to the manner of the embodiment. For example, the upper and lower ends of each of the first support members can be connected respectively to the bottom side of the deflector and the lower wall portion of the duct body. Also, both upper and lower ends of the second support suction can be connected to the upper wall portion of the duct body and the top side of the deflector, respectively. The first support members can be connected to the top side of the deflector (plate member) and not to the upper wall portion, while the second support member can be connected to the lower wall portion and not to the deflector (plate member).

(6) The vehicular intake duct of the present invention can be configured in such a way that the open side of the inlet port which is the open end of the inlet part faces the wall portions of the inlet part perpendicularly. In this case, the incoming line of air taken into the air stream passage through the inlet port matches the flow line of the air stream passage which is guided by the wall portions of the inlet part, making it possible to reduce the pressure loss of the air stream at the inlet part.

In addition, the plate member is provided in the air stream passage defined inside the inlet part having a laterally elongated flat shape, while extending between the right and left wall portions. The plate member can be disposed at either a frontward position or a rearward position in the air stream direction as long as it is located in the air stream passage defined inside the inlet part.

When the upper wall portion of the vehicular intake duct described above is pressed downward, the right and left wall portions thereof tend to fall in the direction of approaching each other with the lower ends being the points of support as the upper wall portion deforms downward. However, the plate member is provided between the right and left wall portions and deforms elastically, so that the duct body receives the resistance while deforming. Because the vehicular intake duct adequately deforms according to the deformation of the engine hood while resisting against the deformation of the engine hood, the duct can thus absorb the impact.

What is claimed is:

1. An intake duct for a vehicle having an air stream passage defined therein so as to communicate with an inlet port and an outlet port connecting to an air cleaner thereof, the inlet port facing a space between a radiator support and an engine hood, the intake duct comprising:

an inlet part having the inlet port and formed in a flat shape expanding in a lateral direction crossing an air stream direction extending from the inlet port to the outlet port; and a plate member provided in the air stream passage of the inlet part and extending in a lateral direction crossing the air stream direction and further comprising:

a first support member provided between a lower wall portion of the inlet part and the plate member to support the plate member; and a second support member provided between an upper wall portion of the inlet part and the plate member to support the upper wall portion, wherein the plate member has flexibility and extends between left and right wall portions constituting side wall portions of the inlet part to separate the air stream passage of the inlet part into a lower area and an upper area, a position where the first support member supports the plate member and a position where the plate member supports the second support member are disposed at different positions along the lateral direction crossing the airstream direction, and the second support member is disposed at a position corresponding to a middle of two adjacent first support members along the lateral direction crossing the air stream direction.

2. The intake duct according to claim 1, wherein the first support member and the second support member are plate-like elements provided so as to extend in the air stream direction.

3. The intake duct according to claim 1, wherein the inlet port is formed so that an open side thereof is directed obliquely upward.

4. The intake duct according to claim 3, wherein the plate member has a guide face formed at a bottom side thereof, which faces the inlet port, and inclined downward from a front side in the air stream direction toward a rear side thereof, and is shaped so that a vertical thickness becomes thinner toward the rear side of the air stream direction from an inclined lower end of the guide face.

5. The intake duct according to claim 3, wherein the plate member has a front end located between a position where the front end is aligned with the open end of the inlet part and the incoming line of air taken orthogonally to the inlet port flowing toward the lower wall portion from a topmost end of the inlet port, and the plate member has a rear end located on the rear side of the incoming line of air taken orthogonally to the inlet port flowing toward the lower wall portion from the topmost end of the inlet port.

6. The intake duct according to claim 1, wherein the first support member and the second support member are positioned at right angles with the plate member.

7. The intake duct according to claim 1, wherein one end of the plate member is coupled to the left wall portion of the inlet part and the other end of the plate member is coupled to the right wall portion of the inlet part.

8. An intake duct for a vehicle having an air stream passage defined therein so as to communicate with an inlet port and an outlet port connecting to an air cleaner thereof, the inlet port facing a space between a radiator support and an engine hood, the intake duct comprising:

an inlet part having the inlet port and formed in a flat shape expanding in a lateral direction crossing an air stream direction extending from the inlet port to the outlet port; and a plate member provided in the air stream passage of the inlet part and extending in a lateral direction crossing the air stream direction and further comprising:

a first support member provided between a lower wall portion of the inlet part and the plate member to support the plate member; and a second support member provided between an upper wall portion of the inlet part and the plate member to support the upper wall portion, wherein the plate member has flexibility and extends between left and right wall portions constituting side wall portions of the inlet part to separate the air stream passage of the inlet part into a lower area and an upper area, a position where the first support member supports the plate member and a position where the plate member supports the second support member are disposed at different positions along the lateral direction crossing the airstream direction, and the first support member is disposed at a position corresponding to a middle of two adjacent second support members along the lateral direction crossing the air stream direction.

9. The intake duct according to claim 8, wherein the first support member and the second support member are plate-like elements provided so as to extend in the air stream direction.

10. The intake duct according to claim 8, wherein the inlet port is formed so that an open side thereof is directed obliquely upward.

11. The intake duct according to claim 10, wherein the plate member has a guide face formed at a bottom side thereof, which faces the inlet port, and inclined downward from a front side in the air stream direction toward a rear side thereof, and is shaped so that a vertical thickness becomes thinner toward the rear side of the air stream direction from an inclined lower end of the guide face.

12. The intake duct according to claim 10, wherein the plate member has a front end located between a position where the front end is aligned with the open end of the inlet part and the incoming line of air taken orthogonally to the inlet port flowing toward the lower wall portion from a topmost end of the inlet port, and the plate member has a rear end located on the rear side of the incoming line of air taken orthogonally to the inlet port flowing toward the lower wall portion from the topmost end of the inlet port.

13. The intake duct according to claim 8, wherein the first support member and the second support member are positioned at right angles with the plate member.

14. The intake duct according to claim 8, wherein one end of the plate member is coupled to the left wall portion of the inlet part and the other end of the plate member is coupled to the right wall portion of the inlet part.

* * * * *